United States Patent [19]

Yoder et al.

[11] 4,079,791

[45] Mar. 21, 1978

[54] ADJUSTABLE SLOPER BLADE FOR BULLDOZERS

[76] Inventors: Curt Thomas Yoder; James H. Etem, both of 1420 Barham Dr., San Marcos, Calif. 92069

[21] Appl. No.: 687,241

[22] Filed: May 17, 1976

[51] Int. Cl.[2] ..... E02F 3/76

[52] U.S. Cl. ..... 172/802

[58] Field of Search ..... 172/802, 806, 801, 786, 172/201; 37/41, 42 R, 42 UL, 50

[56] References Cited

U.S. PATENT DOCUMENTS

| | | | |
|---|---|---|---|
| 3,061,955 | 11/1962 | Violette | 172/802 |
| 3,348,322 | 10/1967 | Stewart | 172/459 |
| 3,429,380 | 2/1969 | Launder | 172/802 |
| 3,429,381 | 2/1969 | Launder | 172/802 |
| 3,430,706 | 3/1969 | Marron | 172/802 |
| 3,464,499 | 9/1969 | McKell | 172/802 |
| 3,861,475 | 1/1975 | Kuncewicz | 172/71 |

FOREIGN PATENT DOCUMENTS

| | | | |
|---|---|---|---|
| 1,525,951 | 4/1968 | France | 172/802 |

*Primary Examiner*—Richard J. Johnson
*Attorney, Agent, or Firm*—James E. Brunton

[57] ABSTRACT

A sloping attachment for use with six-way hydraulic angle and tilt bulldozers, that is, bulldozers of the type having a forwardly mounted adjustable blade which may be raised and lowered as well as pivoted about a centrally disposed, generally vertical axis located in a plane parallel to the plane of the blade and also be rotated about a centrally disposed, generally horizontal axis substantially perpendicular to the plane of the blade.

The sloping attachment of the present invention is pivotally connected to the rear face of the bulldozer blade and may be pivoted through an arc of 90°. The configuration of the attachment and its method of mounting enables it to freely move in all directions along with movement of the bulldozer blade.

6 Claims, 6 Drawing Figures

16
9
14
18
6
5
3
12
3
15

17
12a
4

1
2
10
2
13

11
8
1
10
13
11
8
G
2
4

ADJUSTABLE SLOPER BLADE FOR BULLDOZERS

BACKGROUND OF THE INVENTION

This invention relates to sloping attachments for use with bulldozers. More particularly, the invention relates to sloping attachments for use with bulldozers having blades which may be raised and lowered as well as pivoted about a centrally disposed, generally vertical axis and also be rotated about a centrally disposed, generally horizontal axis (six-way hydraulic angle and tilt bulldozers).

The construction of roadways, driveways, building sites, and related earth work often involves angle cuts. For example specific design requirements may include slopes upwardly at an angle with respect to the roadways, driveways, building sites, or related earth work to prevent the earth from sliding down onto the ground level(s).

Six-way angle and tilt bulldozers of the character previously described are presently used for this type of construction.

The bulldozer moldboard, also called blade, is mounted on the front of the bulldozer in such a manner that it is impossible to use other than in a horizontal angle with respect to the bulldozer. Thus, the design of the sloped areas often requires additional earth-moving equipment, consequently adding time and expense to total construction job.

It is desirable to provide the conventional six way hydraulic angle and tilt bulldozer mounted moldboard with a device which permits the operator to make angles and/or slopes in conjunction with the construction of roadways, driveways, building sites, and related earth work. The sloping attachement of the present invention provides a rugged and reliable design with emphasis in the design to meet the requirements and applications for interface compatability and versatility to fit all six way hydralic angle and tilt bulldozers.

SUMMARY OF THE INVENTION

An object of the invention is to provide a sloping attachment for any six way hydraulic angle and tilt bulldozer(s) that can be set to various angles and which will retain the angle through hard usage.

Another object of this invention is to provide an adjustable sloping attachment that is rugged and able to withstand extreme loads, yet which can be easily removed from the bulldozer in its entirety or attach to the bulldozer as deemed necessary. The attachment when not in use would be carried in the vertical position and clear from moldboard corner of bulldozer, enabling bulldozer to be free for normal operation.

A further object of this invention is to provide an adjustable sloping attachment that does not increase or interfere with the width of the bulldozer, when the attachment is not in operation; controls for the hydraulic power cylinder are already incorporated on most bulldozer(s), thus eliminating the extra expense of new and additional controls.

An additional object of this invention is that angles can be obtained from 0°, when device is in horizontal position up to 90° when device is in the vertical position and all angles between those extremes. The sloping attachment prevents any loose material from by-passing the device into the path of the bulldozer. By eliminating this spillage, bulldozer tilt is eliminated and accurate and clean slope(s) are accomplished at all times.

These and other objects will become apparant from the following detailed description taken in connection with accompanied drawing in which:

BRIEF DESCRIPTION OF THE DRAWINGS

The sloping attachment (sometimes referred to hereinafter as "sloper blade/board device") as shown in FIG. 1 is mounted on any six way hydraulic angle and tilt bulldozer(s), with inside the track dozer arms; equipped with moldboard 18. Referring to FIG. 4 six way hydraulic angle and tilt bulldozers can be seen to have a bulldozer blade adjustably connected to the forward end of the bulldozer body in the manner schematically illustrated. The bulldozer blade has a transversely extending lower cutting edge A and has the capability of being raised and lowered by means of a superstructure B to which the blade is pivotally connected. Superstructure B is, in turn, pivotally connected to the bulldozer body for pivotal movement about axis C which results in up and down movement of the blade. The bulldozer blade also has the capability of being pivoted about a centrally located, generally vertical axis D disposed in a plane generally parallel to the plane of the blade. Additionally, the bulldozer blade has the capability of being rotated about a centrally disposed, generally horizontal axis E which is substantially perpendicular to the plane of the blade. The pivotal movement of the bulldozer blade about the vertical axis is further illustrated in FIG. 5 and the pivotal movement of the bulldozer blade about the horizontal axis is further illustrated in FIG. 6.

Figures 1, 2, 3:
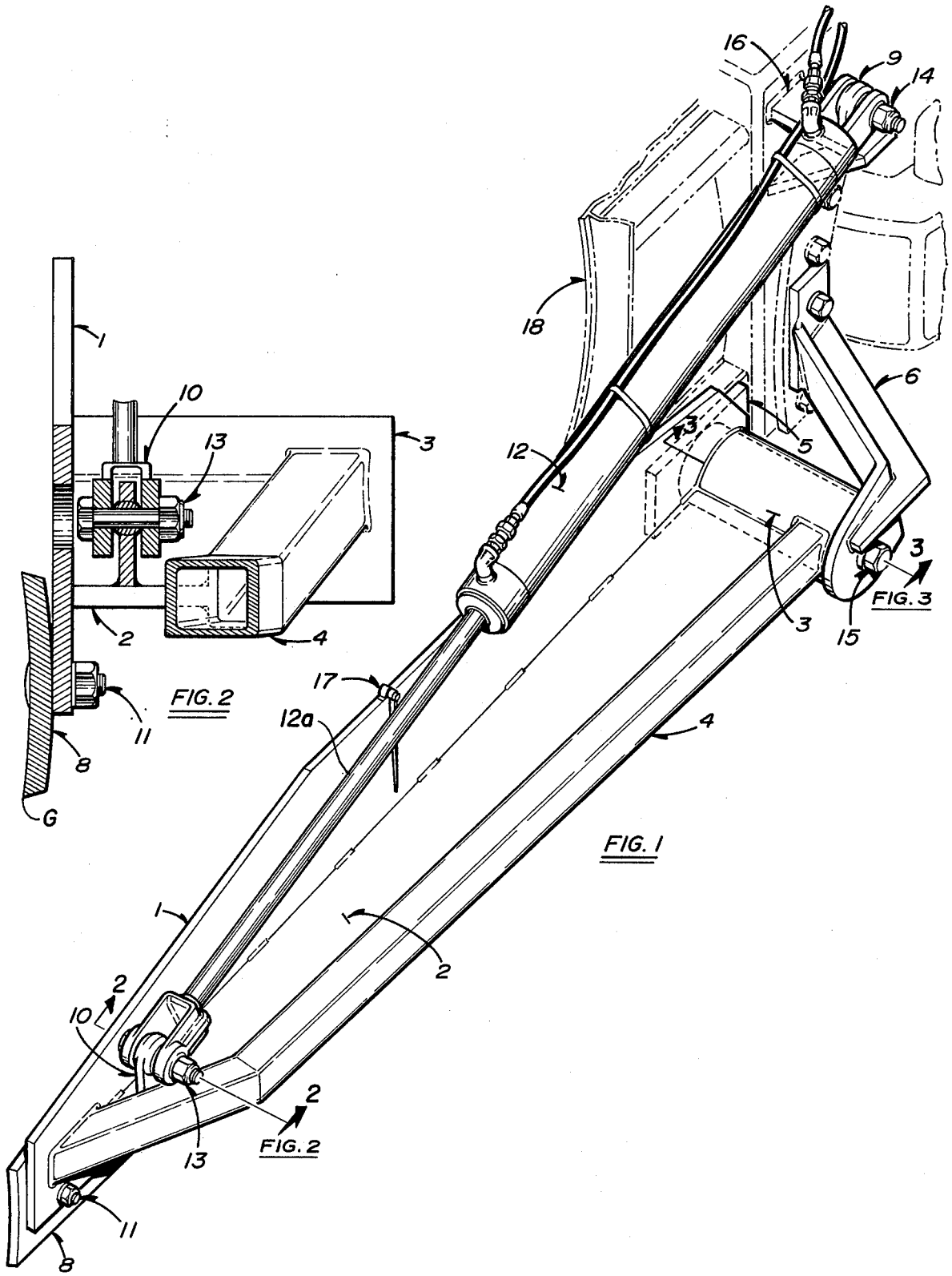
FIG. 1 is a rear view of the sloping attachment, which attaches to any six way hydraulic angle and tilt bulldozers.
FIG. 2 is an enlarged section taken along line 2—2 of FIG. 1, showing the construction of device with cutting edge thereto.
FIG. 3 is an enlarged section taken along line 3—3 of FIG. 1, showing construction of hinge unit, cutting edge and support thereto.
Figure 3:
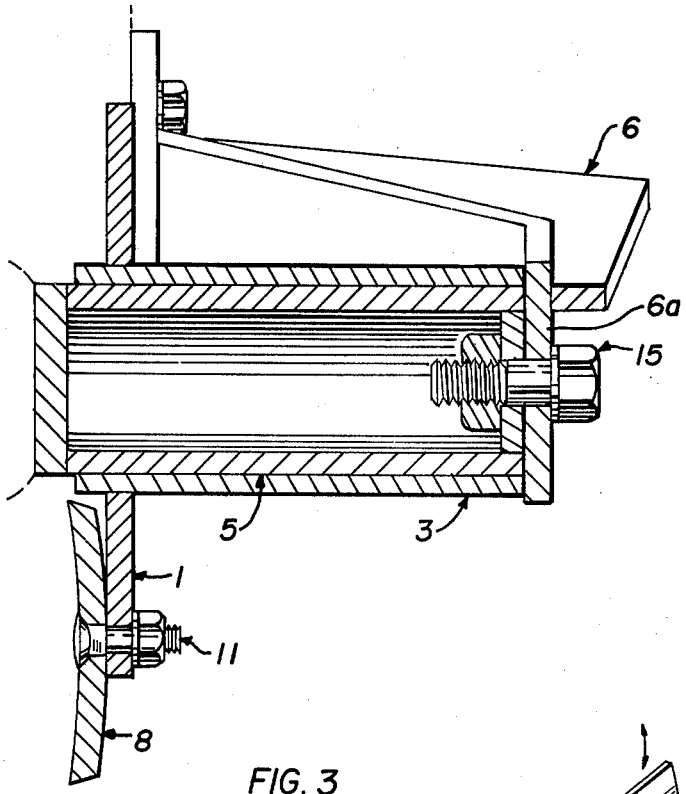
Figure 4:
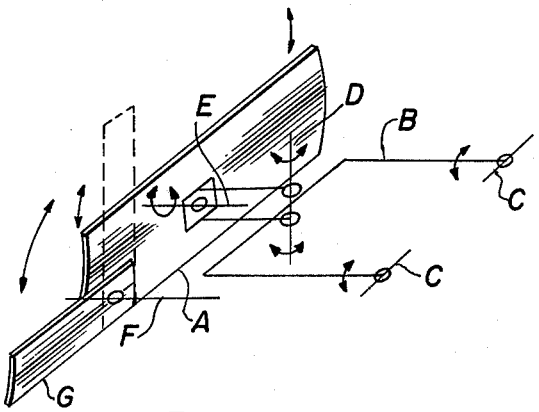
FIG. 4 is a schematic view illustrating the degrees of movement of the six-way hydraulic angle and tilt bulldozer blade and the pivotal movement of the sloping attachment relative to the bulldozer blade.
Figure 5:
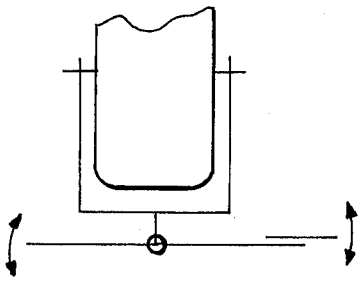
FIG. 5 is a schematic view particularly illustrating the movement of the bulldozer blade about a centrally disposed, generally vertical axis.
Figure 6:
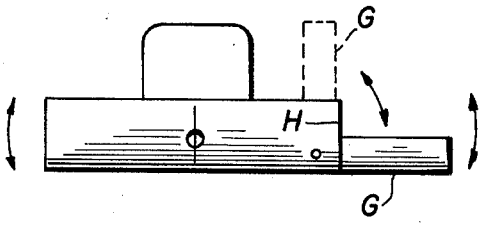
FIG. 6 is a schematic view particularly illustrating the rotational movement of the bulldozer blade about a centrally disposed, generally horizontal axis.

The moldboard 18 has suitable frame which supports the vertical to horizontal sloper, in a generally parallel relationship with respect to bulldozer moldboard 18. As illustrated by FIGS. 2 and 3, the cutting blade or edge 8 is attached to board backing 1 of sloper blade/board device by plurality of nuts and bolts 11. The cutting edge 8 is canted forward at an angle and is reversable when cutting edge 8 dulls by removing the nuts and bolts 11 and turning cutting edge 8 a full 180°. Cutting blade or edge 8 is removably removable for replacement purposes inasmuch as this cutting edge 8 receives the most wear and tear. Earth is cut by cutting edge 8 directed inwardly to board backing 1. Referring again to FIG. 4, connected to the rear face of the bulldozer blade is a hinge means comprising a generally cylindrical hinge tube 3 and a mounting plate and rearwardly extending hinge pin 5 (FIG. 3) defining a pivot axis F extending substantially normal to the plane of the bulldozer blade. It is to be noted that this pivotal axis is disposed inwardly a substantial distance of one lateral margin of the bulldozer blade. The generally rectangular sloping attachment of the present invention has a cutting edge G along one margin there and is carried by the hinge structure for movement with the bulldozer blade and independently of the bulldozer body about the pivot axis F. As is also illustrated in FIG. 6, the sloper blade pivots about axis F from a first position wherein the cutting edge G is substantially parallel to edge A of the bulldozer blade through an arc of approximately 90° to a second position where the cutting edge G is substantially parallel to the lateral margin of the bulldozer blade. Provision is made for holding the sloper blade at any desired intermediate position.

An important feature of the present invention resides in the fact that the sloper blade is of a width such that in its second position the cutting edge G is disposed inwardly of the lateral margin H of the bulldozer blade (FIG. 6). It is also important to note that with the arrangement thus described, the sloper blade is free to move in all directions along with movement of the bulldozer blade.

As will presently be described in detail, the sloping attachment in its lowered operating position is suitably reinforced so as not to deflect out of a plane substantially parallel to the plane of the bulldozer blade. In its retracted position, the sloping attachment is disposed behind the bulldozer blade so as not to interfere with the normal cutting action of the bulldozer blade.

A hydraulic means comprising a hydraulic cylinder 12 and a cooperating, reciprocally movable piston rod 12*a* is provided for moving the sloping attachment from a first to a second position. The hydraulic means is pivotally connected by pins 13 and 14 to cylinder mounts 9 and 10, which are mounted on the rear face of the bulldozer blade by means of mounting plates 10 and 16.

The sloper blade/board is formed as a rectangular shaped blade/board comprising of backing board 1 and cutting edge 8. In providing the sloper blade/board device with adequate strength, a brace tube 4 is adjoined at one end of the sloper backing board 1 by welding thereto, and extends parallel to backing board 1 and is adjoined by welding the other end of brace tube 4 to the hinge tube 3, as best seen and shown in FIG. 1 and cross section FIG. 3.

Supported further for added strength a gusset plate 2 adjoins backing board 1 and tube brace 4 by welding thereto as best seen in FIG. 1 andc cross section FIG. 2.

This construction provides a design of exceptional strength and rigidity and prevents any bowing or bending of board and/or blade. It is seen that the gusset plate 2 will absorb loads imposed on backing board 1 reinforced by tube brace 4. The sloper blade/board device is pivotally connected to the back side of bulldozer moldboard 18 by a hinge structure comprising a center hinge pin with mounting plate 5 welded thereto comprising of a seamless tube.

For purposes of reinforcement, the sloping attachment also includes a first brace member 6 having at one end a cap member 6*a* of a diameter larger than sleeve 3 which is affixed to the hinge pin 5 by means of belt 15. As seen in FIG. 1 brace member 6 is affixed at its opposite end to the bulldozer blade. This structure provides added strength when loads are applied to the sloping attachment.

Upon removal of the sloper blade/board, the center hinge pin with mounting plate 5 and mounting plate 16 remains fastened to the moldboard 18 and does not overhang the side of moldboard 18 as to interfere with normal operation of the bulldozer. A plumb gage 17 is mounted on sloper blade/board for use as a guide when sloper blade/board is in use to determine exact angle of slopes to be constructed.

Operation of sloper blade/board is as follows: The mounting plate 16 and the center hinge pin with mounting plate 5 form a permanent part of the moldboard 18 of the bulldozer. The sloper blade/board may be attached or separated by inserting or removing the end cap bracket 6 and sliding off the sloper blade/board assembly adjoined to hinge tube 3.

The slope angle of the sloper blade/board is obtained by operating the hydraulic cylinder 12. The degree of angle is adjusted upon the controls that operates the hydraulic cylinder 12 by either increasing horizontally or decreasing vertically towards the bulldozer's moldboard 18 to obtain desired angle of earth cutting. The added feature plumb gage 17, allows operator to sight angles of slope without having to check grade angle of slope by use of surveyors transit and never having to dismount from bulldozer.

We claim:

1. A sloping attachment for use with bulldozers of the type having a bulldozer blade adjustably connected to the forward end of the bulldozer body, said blade having a transversely extending lower cutting edge and having the capability of being raised and lowered as well as being pivoted about a centrally disposed, generally vertical axis disposed in a plane generally parallel to the plane of the blade and also being rotated about a centrally disposed, generally horizontal axis substantially perpendicular to the plane of the blade, said sloping attachment comprising:

a. a hinge structure connected to the rear face of the bulldozer blade inwardly a substantial distance of one lateral margin thereof, said hinge structure defining a pivot axis extending substantially normal to the plane of the bulldozer blade;

b. a generally rectangular sloper blade having a cutting edge along one margin thereof, said blade being carried by said hinge structure for movement with said bulldozer blade and independently of said bulldozer body about said pivot axis from a first position wherein said cutting edge is substantially parallel to the cutting edge of the bulldozer blade, through an arc of approximately 90° to a second position wherein said cutting edge is substantially parallel to the lateral margin of said bulldozer blade, said sloper blade being of a width that in its second position the cutting edge thereof is disposed inwardly of the lateral margin of said bulldozer blade; and c. hydraulic means interconnecting said sloping blade and said bulldozer blade for moving said sloping blade from said first position to said second position.

2. A sloping blade attachment as defined in claim 1, including a plumb gage mounted on said sloper blade for use as a guide in determining the angle of the sloper blade with respect to the bulldozer blade.

3. A sloping attachment for use with bulldozers of the type having a bulldozer blade adjustably connected to the forward end of the bulldozer body, said blade having a transversely extending lower cutting edge and having the capability of being raised and lowered as well as being pivoted about a centrally disposed, generally vertical axis disposed in a plane generally parallel to the plane of the blade and also being rotated about a centrally disposed, generally horizontal axis substantially perpendicular to the plane of the blade, said sloping attachment comprising:

a. a hinge element rigidly connected to the rear surface of the bulldozer blade inwardly of one lateral margin thereof, including;
   1. a mounting plate affixed to said rear surface of the bulldozer blade; and
   2. a centrally disposed, rearwardly extending hinge pin connected to said mounting plate and defining a pivot axis lying in a plane substantially perpendicular to the plane of the bulldozer blade;

b. a sloper blade carried by said hinge element for pivotal movement about said pivot axis from a first position wherein said blade forms a lateral extension to the bulldozer blade to a second position wherein said blade is generally perpendicular to the cutting edge of the bulldozer blade, said sloping blade comprising:
   1. a generally rectangular backing board;
   2. a cylindrical sleeve connected to said backing board adapted to closely receive said hinge pin of said hinge element; and
   3. a cutting blade removably connected to said backing board; and c. a hydraulic assembly comprising a hydraulic cylinder pivotally connected to the bulldozer blade and a cooperating reciprocally movable piston rod pivotally connected to said backing board.

4. A sloping attachment as defined in claim 3 including a first bracing member having at one end a cup portion of a diameter larger than the diameter of said cylindrical sleeve affixed to said hinge pin and being affixed at its opposite end to the bulldozer blade.

5. A sloping attachment as defined in claim 4 including a second brace member affixed at one extremity to said backing board proximate its outboard end and affixed at its opposite end to said cylindrical sleeve.

6. A sloping attachment as defined in claim 5 in which said cutting blade is reversably mounted on said backing board and is provided with first and second oppositely disposed earth cutting edges extending along the entire length of said blade.

* * * * *